United States Patent [19]

Lemper

[11] Patent Number: 4,678,022

[45] Date of Patent: Jul. 7, 1987

[54] MOLD-OSCILLATING APPARATUS IN A CONTINUOUS CASTING ASSEMBLY

[75] Inventor: Herbert Lemper, McMurray, Pa.

[73] Assignee: Kabushiki Kaisha Kobe Seiko Sho, Kobe, Japan

[21] Appl. No.: 835,802

[22] Filed: Mar. 3, 1986

[51] Int. Cl.[4] ..... B22D 11/04

[52] U.S. Cl. ..... 164/416; 164/478

[58] Field of Search ..... 164/416, 478, 260, 71.1

[56] References Cited

U.S. PATENT DOCUMENTS

| | | | |
|---|---|---|---|
| 3,262,162 | 7/1966 | Lemper | 164/445 |
| 3,268,956 | 8/1966 | Lemper | 164/442 |
| 3,278,999 | 10/1966 | Lemper | 164/416 |
| 3,318,368 | 5/1967 | Lemper | 164/442 |
| 3,442,145 | 5/1969 | Lemper | 164/416 |
| 3,442,322 | 5/1969 | Lemper | 164/445 |
| 3,453,914 | 7/1969 | Lemper et al. | 164/416 |
| 3,542,117 | 11/1970 | Lemper et al. | 164/416 |
| 3,559,441 | 2/1971 | Lemper et al. | 164/448 |
| 3,585,831 | 6/1971 | Lemper | 164/448 |
| 3,670,587 | 6/1972 | Lemper | 164/448 |
| 3,680,400 | 8/1972 | Lemper et al. | 164/416 |
| 3,739,618 | 6/1973 | Lemper | 164/448 |
| 3,765,210 | 10/1973 | Lemper | 164/448 |

*Primary Examiner*—Nicholas P. Godici
*Assistant Examiner*—Samuel M. Heinrich
*Attorney, Agent, or Firm*—Oblon, Fisher, Spivak, McClelland & Maier

[57] ABSTRACT

A mold-oscillating apparatus in a continuous casting assembly which includes a mold table, a base frame, first and second driven eccentric shafts, a drive mechanism connected to each of the first and second shafts, first and second stationary bearing housings connected to the base frame and within which the first and second shafts are respectively mounted, first and second moving bearing housings connected to the mold table and within which the first and second shafts are respectively mounted and a connecting beam interconnecting the mold table with the first and second moving bearing housings wherein the mold table is oscillated via the connecting beam upon rotation of the first and second shafts by the drive mechanism.

6 Claims, 6 Drawing Figures

MOLD-OSCILLATING APPARATUS IN A CONTINUOUS CASTING ASSEMBLY

BACKGROUND OF THE INVENTION

1. Field of the Invention

The present invention relates to a mold-oscillating apparatus in a continuous casting assembly to maintain relative motion between a mold wall and a continuous casting slab so as to eliminate the possibility of adherence between the same.

2. Discussion of the Background

In a continuous casting apparatus, a strand is withdrawn from a mold along the casting line. In order to effect mold-oscillation during such withdrawal, a conventional system has employed an arrangement such as shown in FIG. 5, in which a relatively rotatable free lever 2 is fitted over an eccentric wheel 1 secured to a driven shaft with an eccentric radius $d_1$, and the lever 2 is connected through a pin 4 to the mold or a mold table 3 mounted on the mold so that upward and downward motion resulting from the rotation of the bearing housing 1 is applied to the mold to create circular oscillations along the curved casting line or vertical upward and downward oscillations along the vertical casting line. Also, a method has been employed wherein lateral displacement of the mold table 3 caused by the rotation of the eccentric wheel 1 is controlled by means of a guide and guide roll (Japanese Utility Model Publication No. 44,888/74) or a leaf spring (Japanese Utility Model Application Laid-Open No. 189,055/83).

However, according to the aforesaid mold-oscillating apparatus, since the lateral displacement included in the rotational motion of the eccentric wheel 1 is absorbed by a connecting portion between the lever 2 and the mold table 3, the pin 4 has to be used at said connecting portion, and the sliding movement resulting from oscillation of the lever 2 occurs in said connecting portion, resulting in wear of the pin or the like, for which periodical maintenance has to be carried out.

Prior art mold-oscillating apparatuses are characterized, for example, by limited oscillation frequencies on the order of 120 to 200 oscillations/minute and therefore are hampered due to the necessary interactions of bushings, pins and corresponding clearances of the structural elements as well as resulting inaccurate motions.

SUMMARY OF THE INVENTION

It is therefore an object of the present invention to provide a mold-oscillating apparatus in which a mold table may be driven by means of two eccentric shafts without forming the sliding portion as described above.

According to the present invention, there is provided a mold-oscillating apparatus in a continuous casting assembly in which in oscillating a mold table by eccentric rotational motion, bearing housings are fitted over two driven eccentric shafts and said mold table and the bearing housings are fixed and connected by means of a connecting beam.

According to the aforementioned means, when the mold table is oscillated up and down through an arc of the curved casting path by the eccentric rotation of the bearing housing, the lateral displacement included in said eccentric rotational motion is absorbed by flexibility of the connecting beam, and thus is not transmitted to the mold table and a pivot structure need not be provided to minimize wear of the parts due to abrasions.

To eliminate inaccuracies in oscillation, especially with small strokes and high oscillation frequencies, two shafts are used with two eccentrics each, placing one eccentric under each corner of the mold table. Thus, any deflection of beams or components subjected to bending forces are eliminated. The four eccentrics provide very accurate vertical motion with the eccentrics near the outside radius having a larger throw than the eccentrics near the inside radius. This feature provides the proper rotation of the mold while it follows the curved casting path. The eccentric oscillator shafts are driven by a common mill type D.C. motor coupled to right angle gear reducers.

The proper horizontal location of the mold throughout its oscillation stroke is accomplished through the use of check rods attached to the oscillator base at one end, and the mold table at the other. Locating the mold table in a direction oriented 90 degrees from casting direction is accomplished by utilizing the thrust capacity of fixed bearings of both shafts in the base frame on one end and fixed bearings of both shafts in the mold table on the other end. The location of the fixed bearings at opposite ends of the assembly will cancel out any shift due to heat expansion of the base and table. No guide rollers with bearings that require lubrication and eventually cause problems due to wear, are used. Adjustability of the check rods permits very accurate location of the mold table.

The vertical oscillation is usually accomplished by eccentrics that operate links which are connected to the mold table by spherical bushings or bearings. The extremely small rotation of these bushings causes lubrication failure in the load zone, resulting in rapid wear and excessive clearances. To avoid these problems, links that are not connected through bearings are utilized, but instead are welded to the mold table. Built-in elastic flexibility permits free rotation of eccentric shafts. The links consist of standard wide flange beams of a web thickness which results in extremely low stresses while deflecting in the horizontal direction and high column strength to transmit the vertical oscillation forces.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
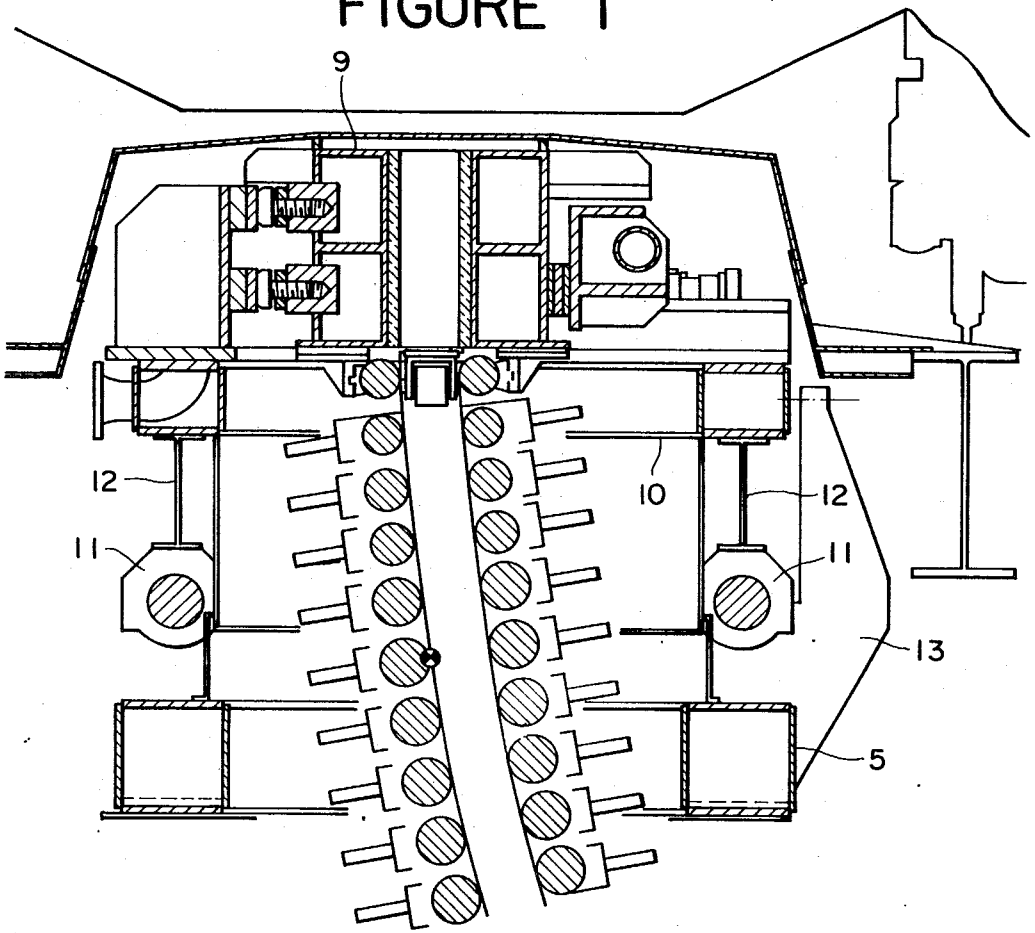
FIG. 1 is a longitudinal sectional elevational view of the present invention.
Figure 2:
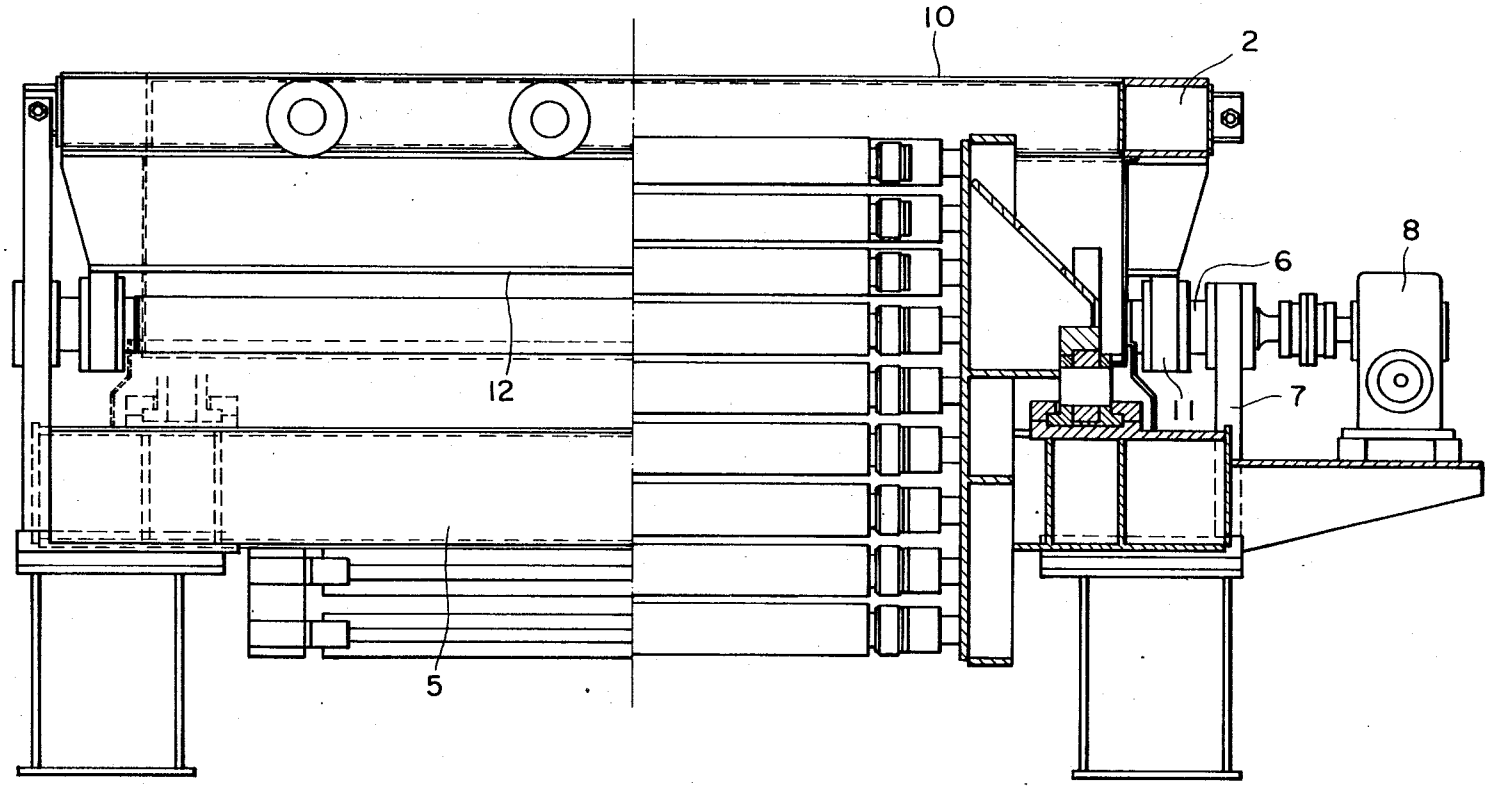
FIG. 2 is a partially sectional side view of FIG. 1.
Figure 3:
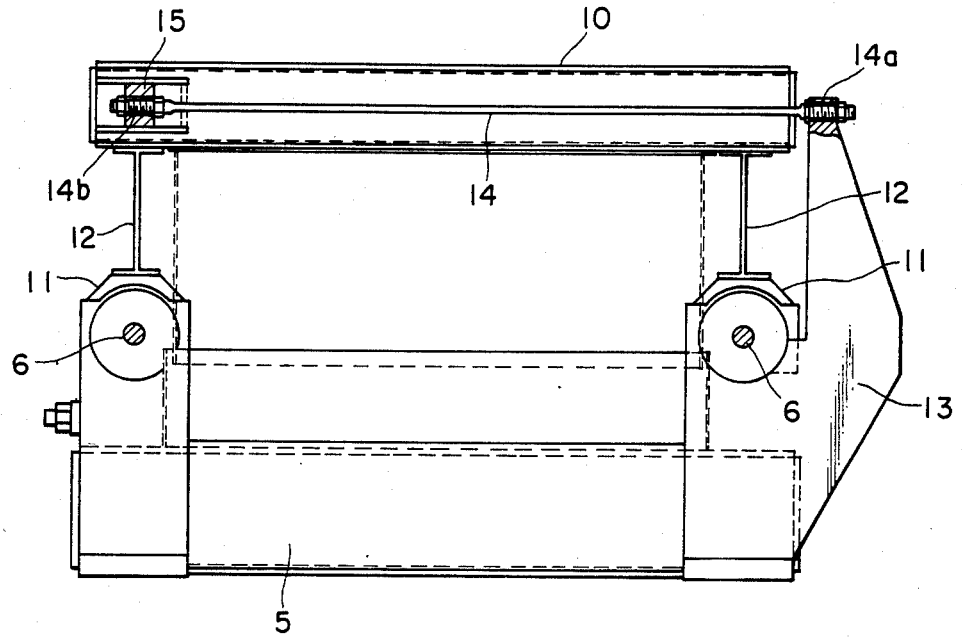
FIG. 3 is a longitudinal sectional view showing the tie rod construction.

Referring now to FIGS. 1 to 4, which show one embodiment of the present invention, a pair of driven eccentric shafts 6 are carried on stationary bearing housing 7 above and on oscillation base frame 5 and rotatable by means of a turning force generated from a gear box 8 and a conventional drive means (not shown). A rectangularly shaped mold table 10 for holding a mold 9 is positioned immediately above the driven shafts 6. On opposite ends of the driven eccentric shafts 6 are provided moving bearing housings 11 relatively rotatably fitted thereover through bearings. A connecting beam 12 having an I-shape in longitudinal section is placed and fixedly mounted between the bearing housings 11, and is likewise fixedly mounted to the mold table 10. The mold table 10 is supported on a oscillator base frame 5 through the connecting beam 12, the bearing housings 11 and the driven eccentric shafts 6.

On one side of the frame 5 is mounted a fixing member 13 extending perpendicularly and upwardly from the base frame 5, so that the upper end thereof is positioned externally of the mold table 10 and receives and supports one end 14*a* of a pair of check rods 14. Each check rod 14 extends parallel to mold table 10, the other end 14*b* of each check rod thereof being received and supported by said mold table 10. Reference numeral 15 denotes a bracket extending from mold table 10 for supporting each check rod 14. Each check rod 14 is oriented in the same direction as the direction of lateral displacement of the bearing housing 11.

Figure 4:
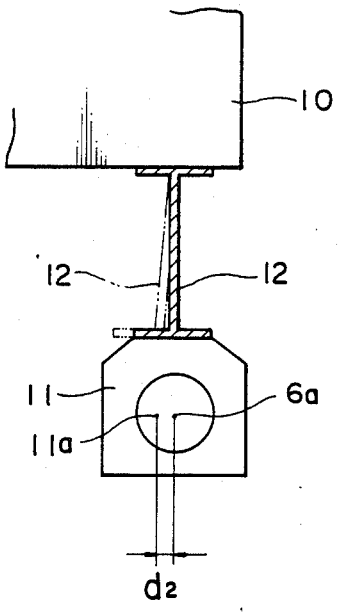
FIG. 4 is a view illustrating operation of the present invention.
Figure 5:
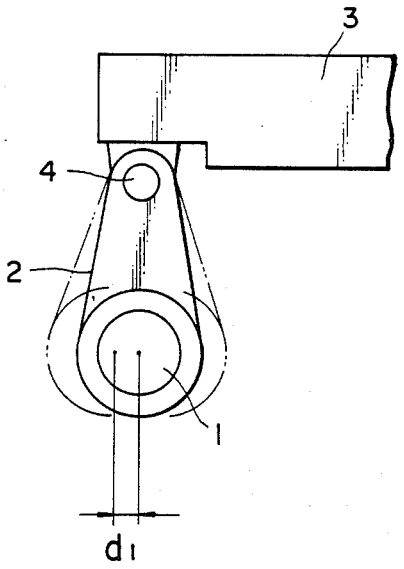
FIGURE 5 PRIOR ART
FIG. 5 is a view showing essential parts of a conventional construction.

Accordingly, when the driven eccentric shafts 6 are rotated with respect to the center of the driving shaft 6 of FIG. 4, the eccentric rotational motion thereof is transferred to the connecting beam 12 and the mold table 10 is oscillated up and down through an arc of the continuous casting curve by the vertical displacing force as a component of the eccentric rotational motion. In FIG. 4, reference number 11*a* represents the center of the eccentric section of each shaft 6 and the eccentric size $d_2$ represents the throw of the eccentric. Moving bearing housing 11, 11 is attached to the mold table 10 through the connecting beam 12 and transmits a circular motion to mold table 10 according to the eccentric center 11*a* of each eccentric shaft 6, 6. In other words, the lateral displacing force as a component of the eccentric rotational motion tends to be transmitted to the mold table 10. However, since the mold table is connected to the fixing member 13 by means of the check rods 14, said transmission is impeded. More specifically, since the check rods 14 can be flexed upward and downward about one end 14*a* supported on the fixing member 13, the aforesaid upward and downward oscillation of the mold table 10 may be effected without any difficulty and can attain an oscillation frequency of 40–400 oscillations/minute or more. Even so, since the lateral displacing force is a force for compressing the check rod 14 in a longitudinal direction and exert a tension force on the same, the lateral oscillation is impeded. For this reason, the lateral displacing force for creating said impeded lateral oscillation is absorbed by the connecting beam 12 to deflect the beam as shown by the chain or phantom line in FIG. 4. In this manner, only the vertical displacing force as a component of the eccentric rotational motion causes the mold table 10 to be driven, and the lateral displacing force is solely absorbed by the connecting beam 12.

Figure 6:
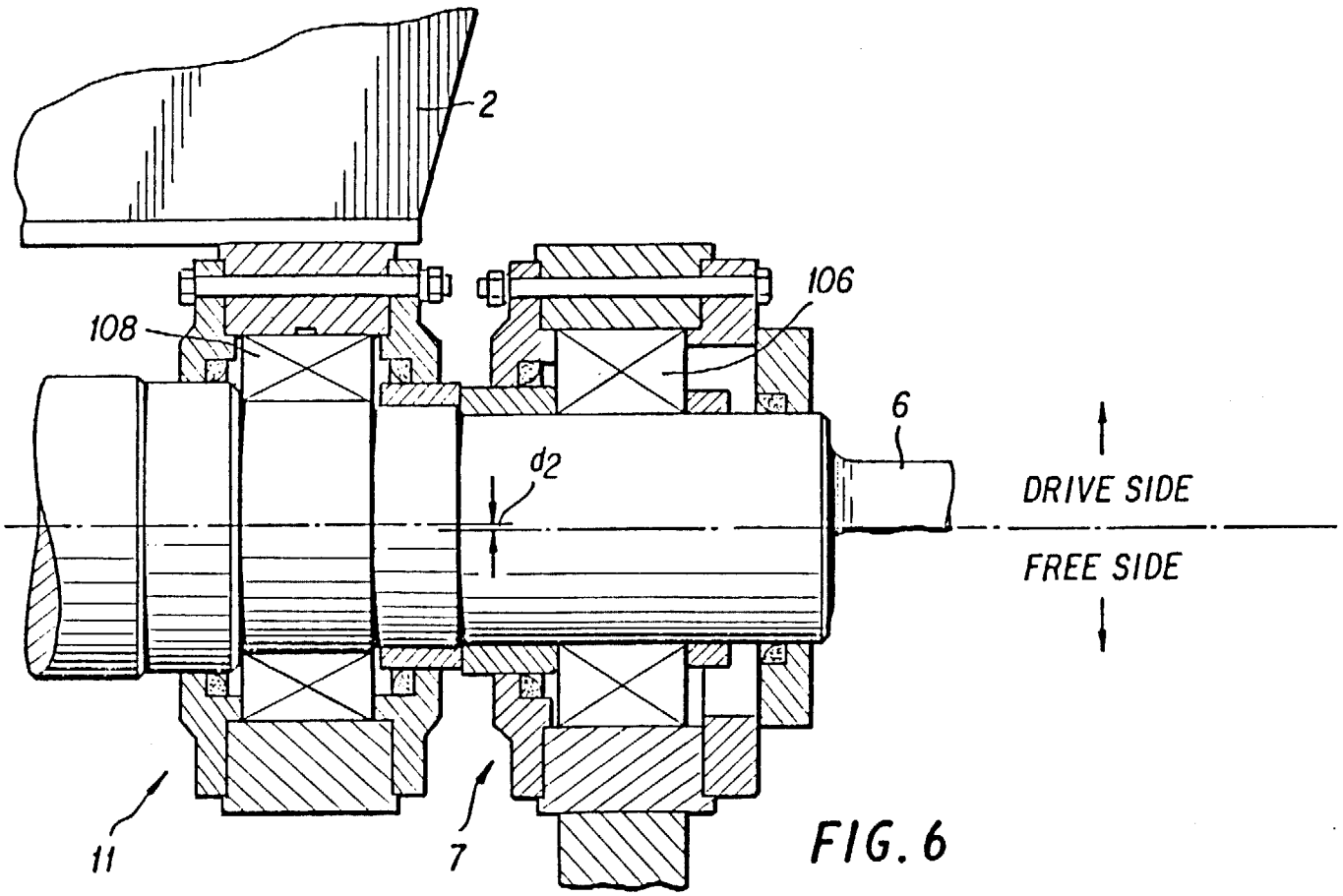
FIG. 6 illustrates the detailed structure of the driven eccentric shafts, stationary bearing housing and moving bearing housing in accordance with the present invention.

With reference to FIGS. 4 and 6, it can be appreciated that the oscillation movement is generated by the two driven eccentric shafts 6, 6 located parallel to the broad face of the slab and driven by a D.C. mill motor (not shown) through a pair of low backlash right angle gear reducers located in gear box 8. The drive system is located on the narrow side end of the oscillator to minimize any effect on the width of the oscillator in the slab thickness direction.

As shown in FIG. 6, each eccentric shaft 6, 6 is mounted in spherical bearings 106, 108 housed in bearing housings 7, 11 and has a pair of matched eccentrics. The pairs of eccentrics generate a stroke of approximately 4 mm on the back face of the mold which follows the casting radius arc. The actual eccentric size or throw is determined by proportioning the size of the desired stroke at the mold back face to the locations of the eccentric shafts 6, 6 on the inside radius and outside radius of oscillation from the center of oscillation which, of course, would be located to the right of the assembly shown in FIG. 1 based upon the curved casting path (e.g. a 4 mm oscillation stroke is changeable only by replacing the eccentric shafts).

The eccentric shaft on the inside radius side has a smaller throw than half the oscillation height or stroke whereas the eccentric shaft on the outside radius side has a throw that is larger than the oscillation height or stroke.

The stroke of the eccentrics is transferred to the mold 9 and mold table 10 by a structural wide flange beam mounted to each pair of eccentrics through spherical bearings with split bearing blocks. A solid connection between the oscillating mold table and the wide flange beam used as the link to the eccentrics is made possible by taking advantage of the elasticity of the steel member. The poor application of non-rotating oscillating bearings, which always are employed in prior art design oscillators to connect the oscillating member to the linkage, have been eliminated. A pair of adjustable parallel check rods 14, 14 are utilized as tension members between the oscillator base frame 5 and the oscillating mold table. Check rods 14, 14 insure an accurate path of oscillation of the mold along the radius of the casting arc.

The eccentric shaft support bearings are positioned at the four corners of the oscillator base to minimize internal frame and steel structure deflections. During field installation, the oscillator assembly is located by shimmed alignment blocks on the support steel structure. The mold table is designed to provide all utility connections to the mold assembly upon placement of the mold assembly on the table.

As described above, in the present invention the lateral displacing force included in the motion of the bearing housings is absorbed by the flexibility of the connecting beam 12 interposed between the mold table 10 and the bearing housings whereby only the vertical displacing force causes the mold table 10 to oscillate. With this arrangement, the use of a slidably contacting connection such as a pin is avoided, thus simplifying the maintenance operation for the mold-oscillating apparatus.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A mold-oscillating apparatus in a continuous casting assembly, comprising:

a mold table;

a base frame;

first and second driven eccentric shafts;

drive means connected to each of said first and second shafts;

first and second stationary bearing housings connected to said base frame and within which said first and second shafts are respectively mounted;

first and second moving bearing housings connected to said mold table and within which said first and second shafts are respectively mounted; and a connecting beam interconnecting said mold table with said first and second moving bearing housings wherein said mold table is oscillated via said connecting beam upon rotation of said first and second shafts by said drive means.

2. The apparatus according to claim 1, wherein said connecting beam is of an I-shape cross section.

3. The apparatus according to claim 1, further comprising a fixing member extending from said base frame and first and second check rods extending parallel with and on opposite sides of said mold table wherein a first end of each of said check rods is connected to said fixing member and a second end of each of said check rods is connected to said mold table.

4. The apparatus according to claim 2, further comprising a fixing member extending from said base frame and first and second check rods extending parallel with and on opposite sides of said mold table wherein a first end of each of said check rods is connected to said fixing member and a second end of each of said check rods is connected to said mold table.

5. The apparatus according to claim 3, wherein each of said check rods is oriented in a direction of lateral displacement of said moving bearing housings.

6. The apparatus according to claim 4, wherein each of said check rods is oriented in a direction of lateral displacement of said moving bearing housings.

* * * * *

UNITED STATES PATENT AND TRADEMARK OFFICE

CERTIFICATE OF CORRECTION

PATENT NO. : 4,678,022

DATED : July 7, 1987

INVENTOR(S) : Herbert Lemper

It is certified that error appears in the above-identified patent and that said Letters Patent is hereby corrected as shown below:

The sheet of Drawing consisting of Figure 6 should be added as per attached sheet.

Signed and Sealed this

Seventeenth Day of November, 1987

*Attest:*

DONALD J. QUIGG

*Attesting Officer*

*Commissioner of Patents and Trademarks*